US009928669B2

(12) United States Patent
Yehezkel et al.

(10) Patent No.: US 9,928,669 B2
(45) Date of Patent: Mar. 27, 2018

(54) SYSTEM AND METHOD FOR PROVIDING OPTIMAL STATE INDICATION OF A VEHICLE

(71) Applicant: Compucar Car Computers Ltd., Givat HaShlosha (IL)

(72) Inventors: Yaniv Yehezkel, Petach Tikva (IL); Alon Schwartzman, Givat HaShlosha (IL); Eyal Cohen, Petach Tikva (IL)

(73) Assignee: Compucar Car Computers Ltd., Givat Hashlosha (IL)

( * ) Notice: Subject to any disclaimer, the term of this patent is extended or adjusted under 35 U.S.C. 154(b) by 0 days.

(21) Appl. No.: 15/500,826

(22) PCT Filed: Jul. 28, 2015

(86) PCT No.: PCT/IL2015/050773
§ 371 (c)(1),
(2) Date: Jan. 31, 2017

(87) PCT Pub. No.: WO2016/020914
PCT Pub. Date: Feb. 11, 2016

(65) Prior Publication Data

US 2017/0330396 A1 Nov. 16, 2017

(30) Foreign Application Priority Data

Aug. 7, 2014 (IL) ..... 233995

(51) Int. Cl.
*G07C 5/08* (2006.01)
*G07C 5/00* (2006.01)

(52) U.S. Cl.
CPC ..... *G07C 5/0825* (2013.01); *G07C 5/008* (2013.01)

(58) Field of Classification Search
CPC ..... G07C 5/008; G07C 5/0825
(Continued)

(56) References Cited

U.S. PATENT DOCUMENTS 6,636,790 B1 * 10/2003 Lightner ..... G01M 15/102 701/31.4
6,732,032 B1 5/2004 Banet
(Continued)

OTHER PUBLICATIONS

International Search Report and Written opinion for PCT App. No. PCT/IL2015/050773 dated Nov. 1, 2015, 8 pgs.

*Primary Examiner* — Marthe Y Marc-Coleman
(74) *Attorney, Agent, or Firm* — Michael A. Bondi; Moss & Barnett

(57) ABSTRACT

A system for providing optimal state indication of a vehicle, which comprises a communication adapter adapted for wirelessly transmitting the on-board diagnostics (OBD) interface of the vehicle to a local computer system including Diagnostic Trouble Code (DTC), ECU identifications, and data readings from one or more sensors of the vehicle; a local computer system (e.g., tablet, PC, smartphone) provided with dedicated software adapted for collecting vehicle data readings and which is capable of automatically identifying the vehicle upon communicating with the OBD of the vehicle via the communication adapter; a server adapted to receive the collected vehicle data from the local computer system, classifying the vehicles into groups according to mileage range, age of vehicle, model, etc. and processing the collected vehicle data for detecting deviations of data that exceeds the allowed range, with respect to each individual sensor of the vehicle, by identifying previous events relevant for the data within the same classified group and compare them with the collected vehicle data and report the processing results to the local computer system or to other local computer systems for sharing the results with other persons/experts.

10 Claims, 1 Drawing Sheet

(58) Field of Classification Search
USPC ..... 701/31.5, 31.4, 34.4, 2
See application file for complete search history.

(56) References Cited

U.S. PATENT DOCUMENTS

| | | | | |
|---|---|---|---|---|
| 2007/0173993 | A1 | 7/2007 | Nielsen | |
| 2008/0015748 | A1* | 1/2008 | Nagy | G07C 5/008 701/31.4 |
| 2008/0082221 | A1* | 4/2008 | Nagy | G07C 5/008 701/2 |
| 2009/0254240 | A1 | 10/2009 | Olsen, III | |

* cited by examiner

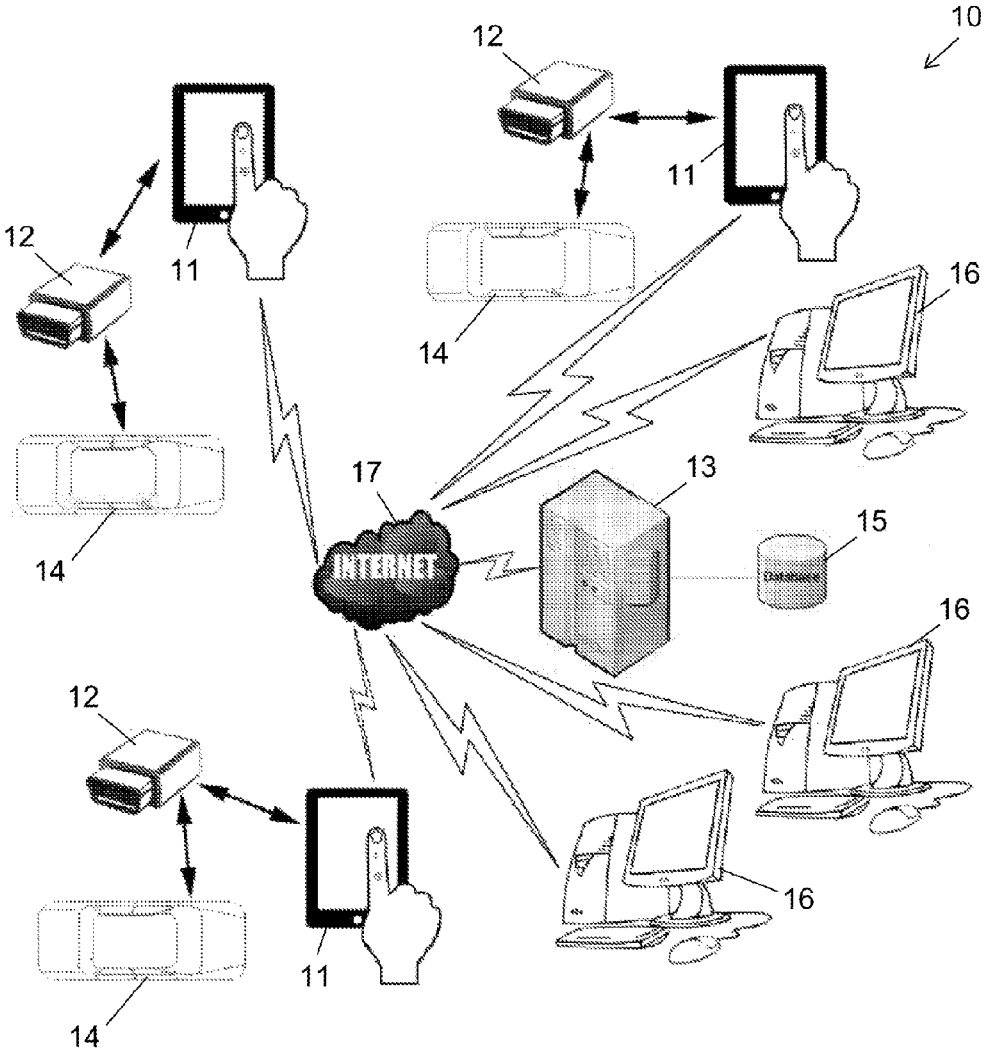
10
12
11
14
16
17
INTERNET
13
15

SYSTEM AND METHOD FOR PROVIDING OPTIMAL STATE INDICATION OF A VEHICLE

FIELD OF THE INVENTION

The present invention relates to the field of vehicle computer system. More particularly, the invention relates to a method and system for providing optimal state indication of a vehicle.

BACKGROUND OF THE INVENTION

Modern cars have built-in computers that can be accessed with the right vehicle monitoring tool. Such monitoring tools are generally called On Board Diagnostics (OBD) or scanners, OBD systems provide access to the status of the various vehicle subsystems and they are usually used as a tool for car mechanics to diagnose problems.

Usually, throughout the car are various computers called Electronic Control Units (ECUs). Each ECU has several jobs: controlling the engine or transmission, rolling up windows, unlocking doors, and the like. These computers have sensors and switches wired in to detect variables such as temperature, pressure, voltage, acceleration at different angles, braking, yaw and roll of the vehicle, steering angle, and many other signals.

Evaluation of the status (diagnosis) of a car or other vehicle system by using the scanning system may contribute to efficient operation and maintenance of the vehicle. Diagnosis of the health of the car and its systems may be utilized to yield a failure in the expected behavior of a car system. For example, a sensor that yields a parameter value that is below a predetermined threshold value. Unfortunately, under certain conditions (e.g., travelling distance, car's age, etc.) the optimal value of such parameter usually may change, and as a result the predetermined threshold value is not set correctly with respect for some of the diagnosed cars (even though such cars can be of the same model). Therefore, the existing scanning systems lack the ability to detect the optimal behavior of the car. For example it may yield a false failure alert, or yield incorrect problem, or sometimes may not detect any malfunction at all.

It is an object of the present invention to provide a system which is capable of detecting optimal behavior associated with car sensors.

It is another object of the present invention to provide a system which is capable of guiding a mechanic/technician to find a solution to different car faults situations.

Other objects and advantages of the invention will become apparent as the description proceeds.

SUMMARY OF THE INVENTION

The present invention relates to a system for providing optimal state indication of a vehicle, comprising:

a) A communication adapter adapted for wirelessly transmitting the on-board diagnostics (OBD) interface of the vehicle to a local computer system including Diagnostic Trouble Code (DTC), ECU identifications, and data readings from one or more sensors of the vehicle;

b) A local computer system (e.g., tablet, PC, smartphone) provided with dedicated software adapted for collecting vehicle data readings and which is capable of automatically identifying the vehicle upon communicating with the OBD of said vehicle via said communication adapter;

c) A server adapted to perform the following tasks:

i. Receiving, via a communication network, the collected vehicle data from said local computer system;

ii. Classifying the vehicles into groups according to one or more parameters, wherein the parameters may include mileage range, age of vehicle, model, etc.;

iii. Processing the collected vehicle data for detecting deviations of data that exceeds the allowed range, with respect to each individual sensor of said vehicle, by identifying previous events relevant for said data within the same classified group and comparing them with said collected vehicle data, wherein said previous event represent either an identical registered failure or similar collected data with respect to each individual sensor, wherein the allowed deviation range is being set according to the previous collected data of vehicles within the same group;

iv. Reporting the processing results to said local computer system or to other local computer systems for sharing said results with other persons/experts, wherein upon detecting deviations of data that exceeds the allowed range, said processing results represent a malfunction of a sensor or component.

According to an embodiment of the invention, the local computer system is adapt to upload data representing a solution to the malfunction of a sensor or component to the server, wherein said uploaded data may include text, images, sounds and other media formats capable of representing the malfunction sensor or component and the solution.

According to an embodiment of the invention, the server is implemented as part of the local computer system.

According to an embodiment of the invention, the server is adapted to communicate with one or more external sources of vehicle's item catalogue for providing information regarding replacement items including their prices.

According to an embodiment of the invention, the local computer system is adapted to capture vehicle data during a test drive of the vehicle.

In another aspect, the present invention relates to a method for providing optimal state indication of a vehicle, comprising the steps of:

a. Collecting normal vehicle data from a plurality of vehicles system that has been diagnosed as working in a normal condition according to predefined reference values;

b. Classifying the vehicles into groups according to one or more parameters, wherein the parameters may include mileage range, age of vehicle, model;

c. For each of said groups, calculating normal average values from the relevant collected normal vehicle data; and d. Setting each calculated normal average value as an updated reference value for each of said groups, thereby allowing diagnosing vehicle condition in an accurate manner.

According to an embodiment of the invention, the method further comprises sampling data generated by vehicle's systems for a predefined period of time, for detecting deviation from the reference values.

According to an embodiment of the invention, the method further comprises generating a graphical representation of the behavior of said vehicle's system along said period of time, thereby allowing to easily detect deviations from reference values, if exist.

According to an embodiment of the invention, the method further comprises for each deviation from reference value(s) in each group allowing to associate information regarding possible solutions.

BRIEF DESCRIPTION OF THE DRAWINGS

In the drawings:

FIG. 1 schematically illustrates a system for providing optimal state indication of a vehicle, in accordance with an embodiment of the present invention.

DETAILED DESCRIPTION OF THE INVENTION

Reference will now be made to several embodiments of the present invention, examples of which are illustrated in the accompanying figures. Wherever practicable similar or like reference numbers may be used in the figures and may indicate similar or like functionality. The figures depict embodiments of the present invention for purposes of illustration only. One skilled in the art will readily recognize from the following description that alternative embodiments of the structures and methods illustrated herein may be employed without departing from the principles of the invention described herein.

According to an embodiment of the invention, a system for providing optimal state indication of a vehicle is provided. The system comprises a communication adapter adapted for wirelessly transmitting On-Board Diagnostics (OBD) interface of the vehicle to a computer system (e.g., tablet, PC, smartphone, etc.). Vehicle data provided via the OBD interface may include Diagnostic Trouble Code (DTC), Electronic Control Unit (ECU) identification and sensors readings.

The computer system is provided with dedicated software adapted for:

- collecting the vehicle data and forwarding the collected data for processing. The data processing of the vehicle data can be performed at a remote server, locally at the computer system, or by combination of both the remote server and the computer system;
- automatically identifying the vehicle; and
- presenting information regarding data readings of DTC, ECU identification and one or more sensors of the vehicle, and indication whether the readings of each sensor are within an allowed range or not.

The allowed range of each sensor enables to define two possible behavior modes of a sensor or component in a vehicle (i.e., normal or malfunction behaviors). According to an embodiment of the invention, the allowed range of each sensor is dynamically set according to processing of data aggregated/collected from a plurality of specific vehicles that are classified under the same parameters or group (e.g., classifying the vehicles into groups according to one or more parameters, wherein the parameters may include mileage range, age of vehicle, model, etc.).

Optimal state indication of a vehicle, in accordance with an embodiment of the present invention, utilizes vehicle communications via the OBD to create and refine one of two possible behavior modes of a sensor or component in a vehicle: the first defines a normal condition model for describing a normal behavior of a sensor, or of a system or component of a vehicle; the second defines a malfunction behavior model for describing a failure to function in a normal or satisfactory manner of a sensor, or of a system or component of a vehicle. A vehicle may be provided with one or more sensors that sense a current state of a vehicle system or component. Sensor readings from a plurality of vehicles are communicated to a processing unit, either locally (e.g., a local computer system, such as a tablet) or remotely (e.g., a server).

A subset of the plurality of vehicles (group of vehicle classified under the same parameters) may be sufficiently similar to one another such that sensor readings from vehicles classified under that group may be relevant to define a malfunction behavior model and a normal condition model for each individual sensor or component of a vehicle. The term "normal condition model" refers herein to a normal behavior of a vehicle sensor's values, for a particular component of a vehicle, or for a particular system or subsystem of a vehicle classified under the same group. The term "malfunction behavior model" refers herein to an abnormal behavior of a vehicle's sensor values, for a particular component of a vehicle, or for a particular system or subsystem of a vehicle classified under the same group. For example, the vehicles of the same group, or a system or component of each of the vehicles of the same group, may be characterized by one or more common or similar characteristics, such as mileage range, aging, year, model, etc.

Normal Condition Model

The processing unit may incorporate the received or collected vehicle data from the same group into the normal condition model. In this model, data from sensor readings may be used to calculate or update a value of a parameter of the normal condition model for each individual sensor or component by applying simple average calculation method that uses the minimum and maximum values obtained from scans of vehicle sensors or components that yield no faults and there is no DTC in the control unit. Alternatively, another statistical method may be applied in order to update one or more parameters of the normal condition model in accordance with received vehicle data. The vehicle data may refer to DTC including freeze frame, vehicle identifications, data from one or more sensors of a vehicle, etc.

Malfunction Behavior Model

The processing unit may incorporate the received or collected vehicle data from the same group into the malfunction behavior model. In this model, data from sensor readings may be used to build an "image" of an event that describes a condition in which a sensor, or of a system or component of a vehicle fail to function in a normal or satisfactory manner. In addition, building such an image may also include information retrieved from previously stored known vehicle's failures (i.e., previous registered events) and/or information regarding malfunction parameters of sampled sensors readings during a determined period of time. Malfunction parameters can be determined according to deviation from normal values as defined by the normal condition model.

The system of the present invention searches among stored images of previous events for an event that essentially may match the current malfunction behavior model. If no match is found, the system provides the sensors readings that deviate from normal values range as defined by the normal condition model.

Upon finding a match, the system provides the solutions associated with the previous matching events as a suggestion for a possible solution for the current malfunction behavior model. The system of the present invention stores solutions and guidance for already solved or known vehicle malfunction.

The following discussions are intended to provide a brief, general description of a suitable computing environment in which the invention may be implemented. While the invention will be described in the general context of program modules that execute in conjunction with an application program that runs on an operating system on a scanner and/or a server, those skilled in the art will recognize that the invention may also be implemented in combination with other computer systems.

FIG. 1 schematically illustrates a system 10 for providing optimal state indication of a vehicle, in accordance with an embodiment of the present invention. System 10 comprises a scanner 11, a communication adapter 12 and a server 13.

The communication adapter 12 is a programmed microcontroller (such as the ELM327 produced by ELM Electronics or STN1110 produced by OBD SOLUTIONS) for translating the on-board diagnostics (OBD) interface found in the vehicle 14. The communication adapter 12 abstracts the low-level protocol and presents a simple interface that can be called via a UART, by the scanner 11 connected by USB, RS-232, Bluetooth or Wi-Fi. The communication adapter 12 adapted to support communication protocols with the vehicle via the OBD, such as ISO 15765-4 (CAN), ISO 14230-4 (Keyword Protocol 2000), ISO 9141-2 (Asian, European, Chrysler vehicles), J1850 VPW (GM vehicles), J1850 PWM (Ford vehicles), Single Wire CAN (GM), Medium Speed CAN (Ford).

Scanner 11 is a vehicle diagnostic tool adapted to communicate with the onboard computer of a vehicle 14 via the communication adapter 12. Scanner 11 can be a tablet, a laptop, a smartphone or other computer system provided with dedicated software for managing vehicle data and with wireless communication means, such as Bluetooth, WiFi, and the like. Optionally, scanner 11 may further include GPS or other location based means.

Scanner 11 may communicate with the server 13 via any communication protocol, such as the Internet as indicated by numeral 17. Server 13 includes a computer readable medium for storing program instructions for operation of the server 13. Such instructions may include, for example, instructions for one or more operations or modules related to vehicle data management, such as calculating the normal condition model and building an "image" of an event of the malfunction behavior model. Server 13 may be utilized to store data or parameters for use by scanner 11 during operation, results of operation of scanner 11, or sensor or other data received from scanner 11 from vehicle 14.

A processor of server 13 may communicate with an associated database 15. The database may represent one or more local or remote memory devices that may communicate with server 13. The database 15 may include data that is collected from a plurality of vehicles, including information regarding solutions and guidance for previously solved malfunction events.

According to an embodiment of the invention, the server 13 associated with one or more information sources adapted to provide step by step solution to detected faults situations and to communicate such solutions to the scanner 11. For example, database 15 can be used as such information source. For example, an optional computer system, such as a PC 16, can be used to retrieve information from server 13 or to provide information such as the step by step solution.

Server 13 may be operated to execute a method for vehicle data management, in accordance with an embodiment of the present invention. Execution of the method for collaborative vehicle data management may result in generation or updating of a normal condition model for indicating the state of a vehicle, or of a vehicle system or component. The indication may be calculated from the model on the basis of measured parameters related to vehicle, or vehicle system or component, operation.

Data related to the normal function of a vehicle or one or more vehicle systems may be collected from vehicles classified under the same group. For example, a group of vehicles may communicate with a processor such as a server or vehicle onboard computer that is executing vehicle data management method. Each vehicle may communicate via a network or other communications channel with the server 13 via the scanner 11. The communicating vehicles may be limited to vehicles that are subscribing to a service, or are otherwise enabled to communicate normal vehicle condition related data to the scanner 11.

Communicated vehicle data may be saved, for example, in a database. The database may be located at a single location, e.g. in one or more data storage devices that are associated with the server 13, or may be distributed among intercommunicating devices. The saved vehicle data represent parameters that may be adjusted or calibrated for each particular group of vehicles, separately.

A normal condition model that is characterized by a particular set of parameters may be relevant to a specific vehicle related to the group of vehicles from which vehicle data was collected.

The group to which a particular set of parameters apply may be defined by one or more common characteristics. For example, such a group may include all vehicles that include a single type of component or system. A single type of component or system may be characterized by having, for example, a common engine, model number, year of manufacture, or other characteristics. The group may be limited to those vehicles that are similar to one another. For example, a group of similar vehicles may be characterized by vehicles having a common or similar type, make, model, year of manufacture, or engine type. The group may also be limited to those vehicles that are subject to similar environmental conditions, e.g. operating in the same or similar geographic areas or climate zones. The group may similarly be limited to those vehicles that are operated under similar operational conditions, e.g. being either privately owned or owned by a company or fleet, primarily designated for family use, commuting, or business use, or a typical distance driven during standard period of time. The group may be limited to vehicles whose age, e.g. measured in days in service or in distance traveled (mileage), is greater than a threshold value (since the data from such vehicles may be more statistically reliable than data from younger vehicles, or more accurate than factory accelerated aging testing).

A normal condition model that incorporates results of vehicle data from the selected group may represent a change from a previous (or initial as set by the manufacture) version of the normal condition model parameters. For example, an initial version of the normal condition model may have been based on calculations or measurements that were made during manufacture or development of a vehicle, or of a vehicle component or system (e.g. using accelerated aging or other estimation techniques). Changes that occurred in the collected vehicle data since the previous execution of vehicle data management method may result in a revision of one or more parameters in the normal condition model. For example, repeated measurements as a group of vehicles are used or age may result in refinement of the reference parameters used in the initial normal condition model.

Vehicle data from a particular vehicle may be acquired and analyzed so as to adapt the reference parameters of the normal condition model to that particular vehicle (or vehicle component or system).

As will be appreciated by the skilled person the arrangement described in the figures results in a system which is capable of detecting optimal behavior associated with car sensors. Moreover, the system of the present invention is capable of guiding a mechanic/technician to find a solution to different car faults situations.

Those skilled in the art will appreciate that the invention may be practiced with other computer system configurations, including hand-held devices, multiprocessor systems, microprocessor-based or programmable consumer electronics, minicomputers, mainframe computers, and the like. The invention may also be practiced in distributed computing environments where tasks are performed by remote processing devices that are linked through a communications network. In a distributed computing environment, program modules may be located in both local and remote memory storage devices.

The terms, "for example", "e.g.", "optionally", as used herein, are intended to be used to introduce non-limiting examples. While certain references are made to certain example system components or services, other components and services can be used as well and/or the example components can be combined into fewer components and/or divided into further components.

All the above description and examples have been given for the purpose of illustration and are not intended to limit the invention in any way. Many different mechanisms, methods of analysis, electronic and logical elements can be employed, all without exceeding the scope of the invention.

The invention claimed is:

1. A system for providing optimal state indication of a vehicle, comprising:

a) a communication adapter adapted for wirelessly transmitting On-Board Diagnostics (OBD) interface of the vehicle to a computer system, wherein the OBD interface enables to provide data that include vehicle data readings from one or more sensors of the vehicle, Diagnostic Trouble Code (DTC) and Electronic Control Unit (ECU) identification;

b) a computer system adapted for collecting the vehicle data readings from one or more sensors of the vehicle, the DTC, and the ECU identification and for automatically identifying the vehicle upon communicating with said communication adapter; and c) a server adapted to perform the following tasks:

i. Receiving, via a communication network, the collected vehicle data by said computer system;

ii. Classifying the vehicles into groups according to one or more parameters, wherein the parameters may include mileage range, age of vehicle, model iii. dynamically setting an allowed range for each individual sensor according to processing of data collected from a plurality of specific vehicles that are classified under the same parameters or group;

iv. building an "image" of an event that describes a condition in which a sensor, a system or a component of a vehicle fail to function in a normal or satisfactory manner;

v. Processing the collected vehicle data for detecting deviations of data that exceeds the allowed range, with respect to each individual sensor of said vehicle, by identifying previous events relevant for said data within the same classified group and comparing them with said collected vehicle data, wherein said previous events represent either an identical registered failure or similar collected data with respect to each individual sensor, wherein the allowed deviation range is being set according to the previous collected data of vehicles within the same group; and vi. Reporting the processing results to said local computer system or to other local computer systems for sharing said results with other persons/experts, wherein upon detecting deviations of data that exceeds the allowed range, said processing results represent a malfunction of a sensor or component of the vehicle.

2. A system according to claim 1, in which the local computer system further adapt to upload data representing a possible solution to the event, wherein said uploaded data may include text, images, sounds and other media formats capable of representing a malfunction sensor or a component and the solution.

3. A system according to claim 1, in which the server is implemented as part of the local computer system.

4. A system according to claim 1, in which the server is adapted to communicate with one or more external sources of vehicle's item catalogue for providing information regarding replacement items including their prices.

5. A system according to claim 1, in which the local computer system is adapted to capture vehicle data during a test drive of the vehicle.

6. A method for providing optimal state indication of a vehicle, comprising the steps of:

a. Collecting normal vehicle data from a plurality of vehicles' systems that has been diagnosed as working in a normal condition according to predefined reference values;

b. Classifying, using a server, the vehicles into groups according to one or more parameters, wherein the parameters may include mileage range, age of vehicle, model;

c. For each of said groups, calculating normal average values from the relevant collected normal vehicle data; and d. Dynamically setting an allowed range for each individual sensor according to processing of data collected from the systems of vehicles that are classified under the same group and defining a malfunction behavior model and a normal condition model for each individual sensor or component of a vehicle, thereby allowing diagnosing vehicle condition in an accurate manner.

7. A method according to claim 6, further comprising sampling data generated by vehicle's systems for a predefined period of time, for detecting deviation from the reference values.

8. A method according to claim 7, further comprising generating a graphical representation of the behavior of said vehicle's system along said period of time, thereby allowing to easily detect deviations from reference values, if exist.

9. A method according to claim 6, further comprising for each deviation from reference value(s) in each group allowing to associate information regarding possible solutions.

10. A method according to claim 6, further comprising:

a) building an "image" of an event that describes a condition in which a sensor, a system or a component of a vehicle fail to function in a normal or satisfactory manner;

b) searching among stored images of previous events for an event that essentially may match the current malfunction behavior model; and c) Upon finding a match, providing solutions associated with the previous matching events as a suggestion for a possible solution for the current malfunction behavior model.

* * * * *